US009359699B2

(12) United States Patent
Hashiguchi

(10) Patent No.: US 9,359,699 B2
(45) Date of Patent: Jun. 7, 2016

(54) INDUSTRIAL TWO-LAYER FABRIC

(71) Applicant: NIPPON FILCON CO., LTD., Inagi-shi, Tokyo (JP)

(72) Inventor: Teppei Hashiguchi, Fuji (JP)

(73) Assignee: NIPPON FILCON CO., LTD., Inagi-Shi, Tokyo (JP)

( * ) Notice: Subject to any disclaimer, the term of this patent is extended or adjusted under 35 U.S.C. 154(b) by 0 days.

(21) Appl. No.: 14/422,548

(22) PCT Filed: Dec. 25, 2013

(86) PCT No.: PCT/JP2013/084593

§ 371 (c)(1),
(2) Date: Feb. 19, 2015

(87) PCT Pub. No.: WO2014/125744

PCT Pub. Date: Aug. 21, 2014

(65) Prior Publication Data

US 2015/0218736 A1 Aug. 6, 2015

(30) Foreign Application Priority Data

Feb. 15, 2013 (JP) ..... 2013-028206

(51) Int. Cl.
*D03D 11/00* (2006.01)
*D21F 1/00* (2006.01)

(52) U.S. Cl.
CPC ..... *D03D 11/00* (2013.01); *D21F 1/0036* (2013.01); *Y10T 442/3179* (2015.04)

(58) Field of Classification Search
CPC . D03D 11/00; D03D 1/00; D03D 2700/0111; D03D 2700/0155; D21F 1/0045; D21F 1/0054; Y10T 442/3179
USPC ..... 15/208; 139/383 R, 384 R, 338, 410, 139/411, 425 A; 162/900, 901, 904; 442/203, 204, 205, 206, 207, 208
See application file for complete search history.

(56) References Cited

U.S. PATENT DOCUMENTS

2006/0278295 A1* 12/2006 Ueda et al. ..... 139/383 A

FOREIGN PATENT DOCUMENTS

JP 3 530 623 B 9/1996
JP 4 584 398 B 8/2001

(Continued)

OTHER PUBLICATIONS

International Search Report for PCT/JP2013/084593 (1 page).

*Primary Examiner* — Arti Singh-Pandey
(74) *Attorney, Agent, or Firm* — Flynn, Thiel, Boutell & Tanis, P.C.

(57) ABSTRACT

The object of the present invention is to provide an industrial two-layer fabric which exhibits excellent air permeability with good wear resistance to prevent the wire mark or the hydration mark, while exhibits high rigidity. The present invention includes at least one upper surface side fabric constituted by upper surface side warps and upper surface side wefts, at least one lower surface side fabric constituted by lower surface side warps and lower surface side wefts, and lower surface side warps serving as binding weft yarns, and includes three upper surface side warps arranged to be adjacent to each other in the upper surface side fabric, whereby the upper surface side wefts pass over three consecutive upper surface side warps, and then, pass under one upper surface side warp to pass over another upper surface side warp, and then, passes under three consecutive upper surface side warps.

2 Claims, 3 Drawing Sheets

(56) References Cited

FOREIGN PATENT DOCUMENTS

| | | | |
|---|---|---|---|
| JP | 2004-068168 | A | 3/2004 |
| JP | 2007-119965 | A | 5/2007 |
| JP | 2008-025060 | A | 2/2008 |
| JP | 2010-126848 | A | 6/2010 |

* cited by examiner

INDUSTRIAL TWO-LAYER FABRIC

TECHNICAL FIELD OF THE INVENTION

The present invention relates to an industrial two-layer fabric which exhibits good air permeability with good wear resistance and high rigidity, in particular, relates to the industrial two-layer fabric which can obtain good hydration property by decreasing a space density and exhibits high rigidity by increasing shooting counts of wefts.

BACKGROUND ART

Fabrics obtained by weaving warps and wefts have conventionally been used widely as an industrial fabric. They are, for example, used in various fields including papermaking fabrics, conveyor belts and filter cloths and are required to have fabric properties suited for the intended use or using environments. Of such fabrics, a papermaking fabric used in a papermaking step for removing water from raw materials by making use of the network of the fabric must satisfy a severe demand.

For example, there is a demand for the development of fabrics which do not transfer a wire mark of the fabric and therefore have excellent surface property, the ones which have enough hydration property for sufficiently and uniformly hydrating excess water contained in the material and enough rigidity or wear resistance to be usable desirably even under severe environments, or the ones which are capable of maintaining conditions necessary for making good paper for a prolonged period of time.

In addition, fiber supporting property, improvement in a paper making yield, dimensional stability and running stability are demanded.

In recent years, owing to the speed-up of a paper making machine, requirements for papermaking fabrics become severe further.

Since most of the demands for industrial fabrics and solutions thereof can be understood if papermaking fabrics on which the most severe demand is imposed among industrial fabrics is described, the papermaking fabric will hereinafter be described as a representative example.

Recently, particularly excellent hydration property and surface smoothness have been required due to the high speed operation of a machine for fabric. Although the required hydration property varies in accordance with the machine and the product papers, the uniform hydration property is commonly required for all the product papers.

In addition, the sufficient and uniform hydration property has become important, since old papers has been increasingly used in recent years, so that the sufficient hydration is not carried out due to the much fine fibers contained therein.

Further, generally, the fabric is formed by intermitting warps each arranged to be straight, so that the distance between wefts and warps is kept constant if the woven structure is changed. Accordingly, another technical problem of a generation of wire mark has risen due to the straight space formed between the warps.

In order to solve above technical problems, the fabric which adopts so-called a lateral structure in which the warps and the wefts are woven with each other in a meandering manner. For example, in Patent Publication 1, a two-layer fabric for making papers in which such a lateral structure is formed on an upper surface side warps is disclosed. In Patent Publication 2, an industrial two-layer fabric in which such a lateral structure is formed on an upper surface side wefts is disclosed. In Patent Publication 3, a single layer fabric for making papers in which a lateral crimp is formed on warps is disclosed.

However, in the two-layer fabric for making papers in Patent Publication 1, a technical problem related to rigidity, etc. has risen due to use of the wefts as warp binding yarns.

In addition, in the industrial two-layer fabric in Patent Publication 2, it is technically difficult to increase the number of the shooting counts of the wefts, due to the fact that the fabric is formed by meandering the wefts relative to the running direction thereof to a higher degree, as compared to the normal wefts.

Further, in the single layer fabric for making papers in Patent Publication 3, the surface smoothness and the wear resistance are inferior to the two-layer fabric.

Patent Publication 1: Japanese Patent No. 4584398

Patent Publication 2: Japanese Patent Laid-open Publication 2010-126848

Patent Publication 3: Japanese Patent No. 3530623

DISCLOSURE OF THE INVENTION

Technical Problems to be Solved by Present Invention

The object of the present invention is to provide an industrial two-layer fabric which exhibits excellent air permeability with good wear resistance to prevent the wire mark or the hydration mark, while exhibits high rigidity.

Means to Solve Technical Problems

The industrial two-layer fabric of the present invention includes following technical features in order to solve the above technical problems.

(1) The two-layer fabric with a complete structure of the present invention includes at least one upper surface side fabric constituted by upper surface side warps and upper surface side wefts, at least one lower surface side fabric constituted by lower surface side warps and lower surface side wefts, and lower surface side warps serving as binding weft yarns, and includes three upper surface side warps arranged to be adjacent to each other in the upper surface side fabric, whereby the upper surface side wefts pass over three consecutive upper surface side warps, and then, pass under one upper surface side warp to pass over another upper surface side warp, and then, passes under three consecutive upper surface side warps.

(2) In addition, in the industrial two-layer fabric of the present invention, each of the three upper surface side warps adjacent to each other passes over one or two upper surface side wefts to form one knuckle, and the lower surface side warp serving as the binding weft yarn passes between the upper surface side warp located to be middle among the three upper surface side warps and the upper surface side weft to form another knuckle. In such a structure, the another knuckle formed by the lower surface side warp serving as the binding weft yarn has a technical feature in that the amount in which another knuckle formed by the lower surface side warp serving as the binding weft yarn protrudes toward the upper surface side is less than that of the one knuckle formed by the upper surface side warp.

(3) Still further, in the industrial two-layer fabric of the present invention, the adjacent upper surface side warps are divided into upper and lower sides to be woven with one upper surface side weft at an approach portion where the adjacent upper surface side warps among the three upper surface side warps are the most adjacent in a position other than the one knuckle.

Effect of the Invention

According to the industrial two-layer fabric of the present invention, excellent air permeability with good wear resistance to prevent the wire mark or the hydration mark can be obtained, while high rigidity can be exhibited.

BRIEF EXPLANATION OF DRAWINGS

FIG. 3(*a*) is a cross section view taken along warp 1 in FIG. 1.

FIG. 3(*b*) is a cross section view taken along warp 2 in FIG. 1.

FIG. 3(*c*) is a cross section view taken along warp 3 in FIG. 1.

FIG. 3(*d*) is a cross section view taken along warp 4 in FIG. 1.

FIG. 3(*e*) is a cross section view taken along warp 5 in FIG. 1.

FIG. 3(*f*) is a cross section view taken along warp 6 in FIG. 1.

FIG. 3(*g*) is a cross section view taken along warp 7 in FIG. 1.

FIG. 3(*h*) is a cross section view taken along warp 8 in FIG. 1.

FIG. 6(*a*) is a cross section view taken along warp 1 in FIG. 5.

FIG. 6(*b*) is a cross section view taken along warp 2 in FIG. 5.

FIG. 6(*c*) is a cross section view taken along warp 3 in FIG. 5.

FIG. 6(*d*) is a cross section view taken along warp 4 in FIG. 5.

FIG. 6(*e*) is a cross section view taken along warp 5 in FIG. 5.

FIG. 6(*f*) is a cross section view taken along warp 6 in FIG. 5.

FIG. 6(*g*) is a cross section view taken along warp 7 in FIG. 5.

FIG. 6(*h*) is a cross section view taken along warp 8 in FIG. 5.

DETAILED DESCRIPTION OF THE INVENTION

Figure 1:
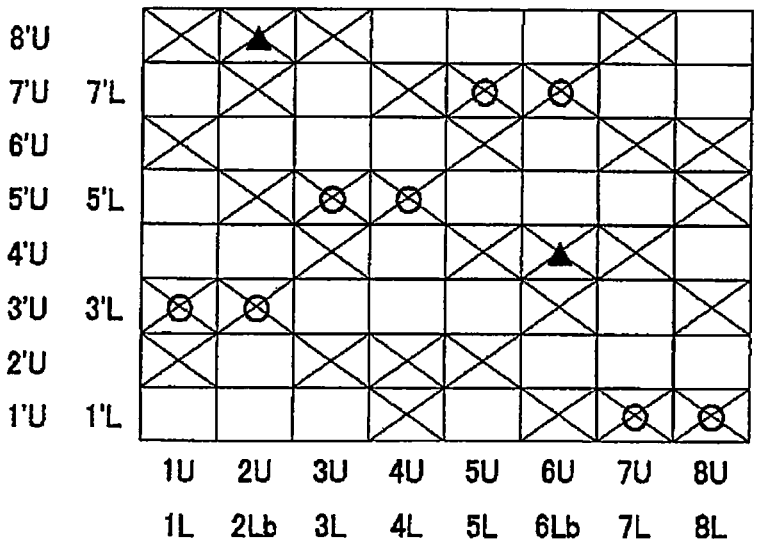
FIG. 1 is a design view showing a complete structure of the first embodiment according to the present invention.

Now, the structure and the effect of the two-layer fabric of the present invention will be described below. Embodiments of the two-layer fabric of the present invention will be described thereafter with reference to the drawings.

The two-layer fabric of the present invention is the one which includes at least one upper surface side fabric constituted by upper surface side warps and upper surface side wefts, at least one lower surface side fabric constituted by lower surface side warps and lower surface side wefts, and binding weft yarns each of which binds the upper surface side fabric and the lower surface side fabric.

The two-layer fabric of the present invention is woven in such a way that three upper surface side warps are arranged to be adjacent to each other in the upper surface side fabric. The upper surface side wefts passes over three consecutive upper surface side warps, and then, passes under one upper surface side warp to pass over another upper surface side warp, and then, passes under three consecutive upper surface side warps.

By adopting such a structure, the upper surface side weft woven with the three upper surface side warps can be largely moved in the height direction of the fabric, so that an upper wire can be thickened, whereby the space density can be decreased. By decreasing the space density, the amount of water kept on the surface can be decreased, which fastens the hydration speed. In addition, the number of the shooting counts of the wefts can be increased to enhance the rigidity of the industrial two-layer fabric.

In addition, in the industrial two-layer fabric of the present invention, each of the three upper surface side warps adjacent to each other may pass over one or two upper surface side wefts to form one knuckle, and the lower surface side warp serving as the binding weft yarn may pass between the upper surface side warp located to be middle among the three upper surface side warps and the upper surface side weft in the one knuckle to form another knuckle. In such a structure, the another knuckle formed by the lower surface side warp serving as the binding weft yarn has a technical feature in that it does not protrude toward the upper surface side above the one knuckle formed by the upper surface side warp. By adopting such a structure, the surface marking property by the biding weft yarn can be improved to prevent the wire mark or the hydration marl from being generated.

In addition, the upper surface side weft passes over the three consecutive upper surface side warps, and then, passes under one upper surface side warp to pass over one upper surface side warp. This causes the two upper surface side warp each located to be an end of the three upper surface side warps to be forced toward the middle. In addition, this causes the upper surface side warp passing over the weft to be forced outside from a mountain shape formed by the three surface side warps.

This causes the lateral structure to be formed by the weft, whereby the number of the shooting counts of the wefts can be increased, and as a result, the industrial two-layer fabric with high rigidity can be provided.

Still further, in the industrial two-layer fabric of the present invention, it is preferable that the adjacent upper surface side warps are divided into upper and lower sides to be woven with one upper surface side weft at an approach portion where the adjacent upper surface side warps among the three upper surface side warps are the most adjacent in a position other than the one knuckle. By adopting such a structure, the hydration passage can be diagonally formed at an approach portion of the lateral structure to decrease the amount of water kept on the surface, whereby the hydration speed can be enhanced.

No particular limitation is imposed on a yarn to be used in the present invention and it can be selected freely depending on the properties which an industrial fabric is desired to have. Examples of it include, in addition to monofilaments, multifilaments, spun yarns, finished yarns subjected to crimping or bulking such as so-called textured yarn, bulky yarn and stretch yarn, and yarns obtained by intertwining them. As the cross-section of the yarn, not only circular form but also square or short form such as stellar form, or elliptical or hollow form can be used. The material of the yarn can be selected freely and usable examples of it include polyester, polyamide, polyphenylene sulfide, polyvinylidene fluoride, polypropylene, aramid, polyether ketone, polyethylene naphthalate, polytetrafluoroethylene, cotton, wool and metal. Of course, yarns obtained using copolymers or incorporating or mixing the above-described material with a substance selected depending on the intended purpose may be used.

As the upper surface side warps, lower surface side warps, and upper surface side wefts, use of a polyester monofilament having rigidity and excellent dimensional stability is usually preferred. When lower surface side wefts which need wear resistance are obtained by interweaving of polyester monofilaments and polyamide monofilaments while arranging them alternately, they are able to have wear resistance without losing rigidity.

It is also possible to place a plurality of yarns with the same design at a position where one yarn is normally placed from the standpoint of design. Design of a plurality of yarns having a thin diameter brings about improvement in surface property and thinning of the fabric.

Now, the embodiments of the present invention will be described below with reference to the drawings. FIG. 1 is a design view showing a complete structure of a first embodiment of the present invention. Here, the design view corresponds to the complete structure of the fabric defining the minimum unit to be repeated of the fabric structure. The fabric recited in the claims corresponds to this complete structure. The final product is completed by combining any number of such complete structures in the longitudinal direction and the direction perpendicular to the longitudinal direction.

In each of the design views, the warp is indicated by a reference number such as 1, 2, 3 . . . . The upper and lower warps are indicated by the reference number to which U and D are attached, respectively.

The weft is indicated by a reference number such as 1', 2', 3' . . . . The upper surface side weft and the lower surface side weft are indicated by the reference number to which u and d are attached, respectively, such as 1'*u*, 2'*d*, etc. In addition, the binding weft yarn and the auxiliary weft are indicated by the reference number to which b and f are attached, respectively, such as 1'*u*, 1'*d*, 2'*b*, 2'*f*, etc.

In each of the design views, a symbol "X" indicates that the upper surface side warp is arranged above the upper surface side weft or the auxiliary weft, and a symbol "○" indicates that the lower surface side warp is arranged below the lower surface side weft. A solid triangle symbol "▲" indicates that the lower surface side warp serving as the binding weft yarn is arranged above the upper surface side weft.

The warps and the wefts on the upper surface side are arranged to be overlapped with the warps and the wefts on the lower surface side, respectively. In this connection, in the design view, the warps and the wefts on the upper surface side are depicted to be precisely arranged over the warps and the wefts on the upper surface side, because of the clarity of the drawing. In the real fabric, it does not matter if they are arranged to be offset.

First Embodiment

Figure 2:
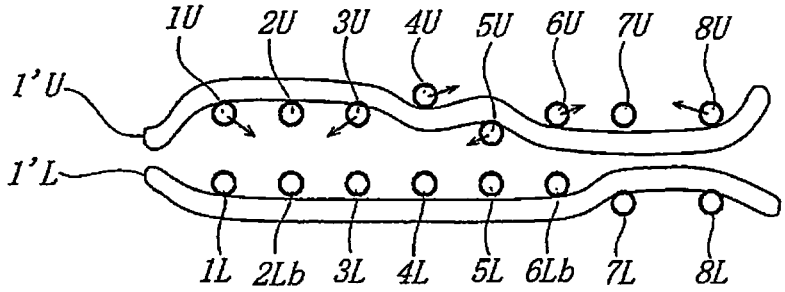
FIG. 2 is a cross section view taken along weft 1' in FIG. 1.
Figure 3:
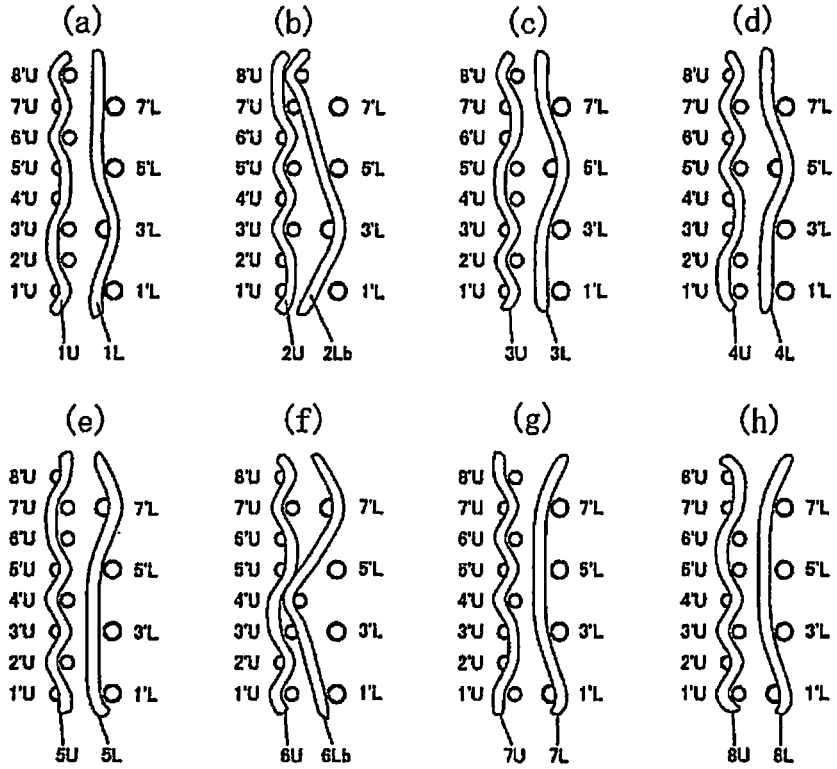
FIG. 3 is a cross section view taken along warp in FIG. 1.

FIGS. 1 to 3 are a design view and a cross section view showing an industrial two-layer fabric according to the first embodiment, respectively.

As shown in FIG. 1, the two-layer fabric of the first embodiment includes upper surface side warps (1U~8U), lower surface side warps (1L~8L), and lower surface side warps 2Lb, 6Lb each serving as a binding weft yarn. In addition, the two-layer fabric of the first embodiment includes upper surface side wefts (1'U~8'U), and lower surface side wefts (1'L, 3'L, 5'L, 7'L) to form eight shafts.

A ratio of the upper surface side wefts (1'U~8'U) to the lower surface side wefts (1'L, 3'L, 5'L, 7'L) is two.

In this embodiment, as shown in FIG. 2, the upper surface side weft 1'U passes over the consecutive three upper surface side warps 1U,2U,3U, and then, passes under the one upper surface side warp 4U to pass over one upper surface side warp 5U and under the consecutive three upper surface side warps 6U,7U,8U.

By adopting such a structure, the upper surface side warp 3U among the three upper surface side warps 1U,2U,3U is pressed toward the middle as shown by an arrow by means of the upper surface side weft 1'U woven with the upper surface side warp 4U. The upper surface side warp 4U is pressed in the opposite direction as shown by an arrow by means of the upper surface side weft 1'U. The upper surface side warp 6U among the three upper surface side warps 6U,7U,8U is pressed toward the middle as shown by an arrow by means of the upper surface side weft 1'U passing over the upper surface side warp 5U. The upper surface side warp 8U is pressed toward the middle as shown by an arrow by means of the upper surface side weft 1'U passing over the three upper surface side warps (not shown). A lateral structure is formed by the wefts according to the above.

As shown in FIG. 3(*a*), the upper surface side warp 1U is woven with the upper surface side wefts 2'U,3'U,6'U,8'U from above. The lower surface side warp 1L located to be under the upper surface side warp 1U is woven with the upper surface side weft 3'L from below. In addition, as shown in FIG. 3(*b*), the upper surface side warp 2U is woven with the upper surface side wefts 3'U,5'U,6'U,7'U from above. The lower surface side warp 2Lb located to be under the upper surface side warp 2U and serving as the binding weft yarn is woven with the lower surface side weft 3'L from below and is woven with the upper surface side weft 8'U from above. Further, as shown in FIG. 3(*c*), the upper surface side warp 3U is woven with the upper surface side wefts 2'U,4'U,5'U,8'U from above. The lower surface side warp 3L located to be under the upper surface side warp 3U is woven with the lower surface side weft 5'L from below. In such a situation, the upper surface side warps 1U,2U,3U adjacent to each other pass over the one upper surface side weft 8'U to form a one knuckle. At this location, the lower surface side warp 2Lb serving as the binding weft yarn passes under the upper surface side warp 2U located to be the middle among the three upper surface side warps and passes over the upper surface side weft 8'U to form another knuckle in the one knuckle. That is to say, the amount in which another knuckle formed by the lower surface side warp 2Lb serving as the binding weft yarn protrudes toward the upper surface side is less than that of the one knuckle formed by the upper surface side warp 2U.

In addition, as shown in FIGS. 3 (*e*) to 3 (*g*), the three upper surface side warps 5U, 6U, 7U adjacent to each other pass over the one upper surface side weft 4'U to form one knuckle. In addition, as shown in FIG. 3 (*f*), at this location, the lower surface side warp 6Lb serving as the binding weft yarn passes under the upper surface side warp 6U located to be the middle among the three upper surface side warps and passes over the upper surface side weft 4'U to form another knuckle in the one knuckle. That is to say, the amount in which another knuckle formed by the lower surface side warp 6Lb serving as the binding weft yarn protrudes toward the upper surface side is less than that of the one knuckle formed by the upper surface side warp 6U.

Figure 4:
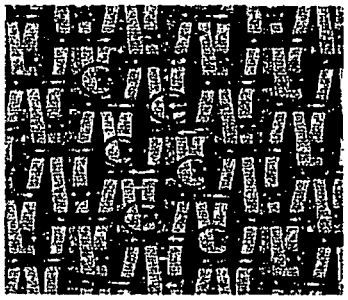
FIG. 4 is a photograph showing the upper surface of the two-layered fabric of the first embodiment.

FIG. 4 is a photograph showing the upper surface of the two-layered fabric of the first embodiment including the complete structure woven by the above descriptions. According to the photograph in FIG. 4, the warps form a lateral structure in a meandering manner.

In addition, according to the photograph in FIG. 4, the adjacent upper surface side warps are divided into upper and lower sides to be woven with one upper surface side weft at an approach portion (a portion enclosed by a circle in the photograph) where the adjacent upper surface side warps among the three upper surface side warps are the most adjacent in a position other than the one knuckle. By adopting such a structure, the hydration passage can be diagonally formed at an approach portion of the lateral structure to decrease the amount of water kept on the surface, whereby the hydration speed can be enhanced.

Second Embodiment

Figure 5:
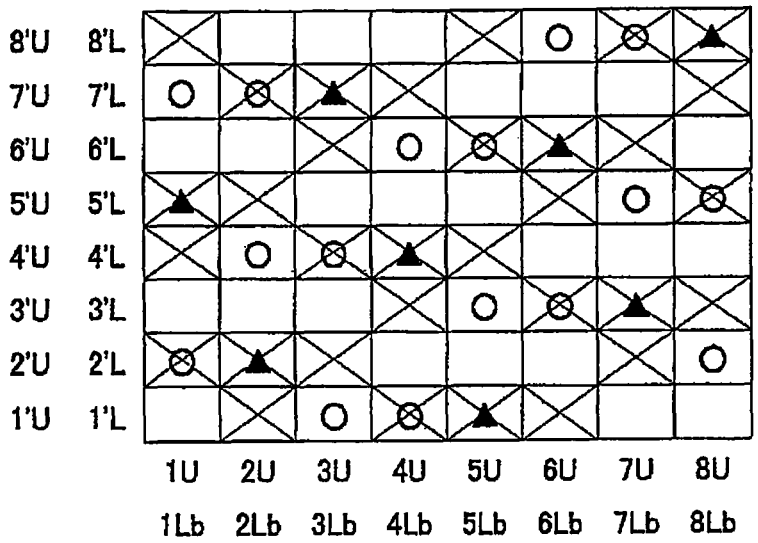
FIG. 5 is a design view showing a complete structure of the second embodiment according to the present invention.
Figure 6:
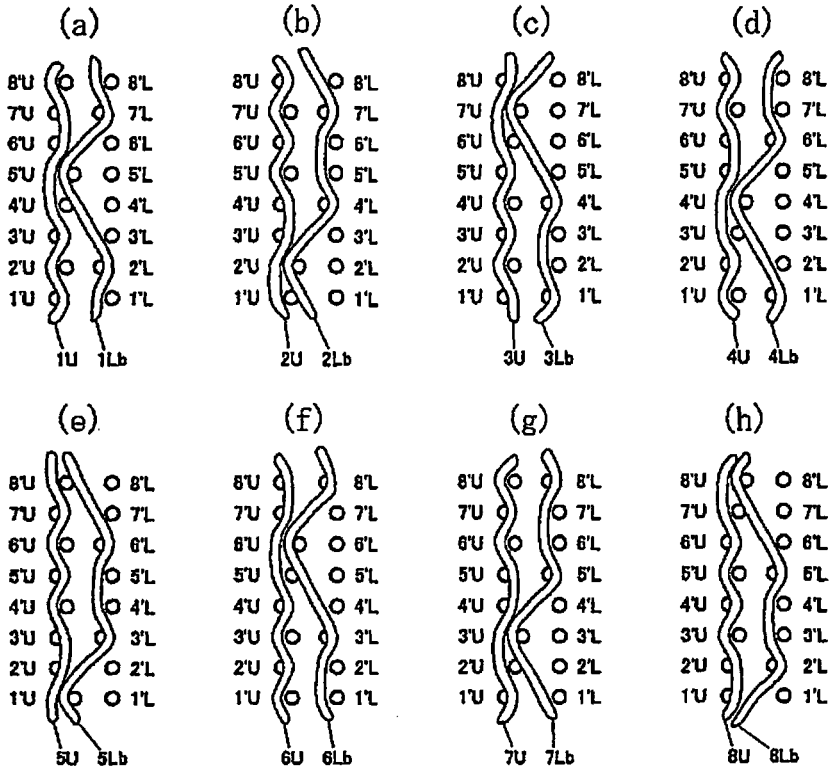
FIG. 6 is a cross section view taken along warp in FIG. 5.

FIGS. 5 to 6 are a design view and a cross section view showing an industrial two-layer fabric according to the second embodiment, respectively.

As shown in FIG. 5, the two-layer fabric of the second embodiment includes upper surface side warps (1U~8U) and lower surface side warps (1Lb~8Lb) each serving as the binding weft yarn. In addition, the two-layer fabric of the second embodiment includes upper surface side wefts (1'U~8'U), and lower surface side wefts (1'L~8'L) to form eight shafts.

A ratio of the upper surface side wefts (1'U~8'U) to the lower surface side wefts (11, 3'L, 51, 7'L) is one.

In this embodiment, as shown in FIG. 6(*a*), the upper surface side warp 1U is woven with the upper surface side wefts 1'U,3'U,4'U,8'U from above. The lower surface side warp 1Lb located below the upper surface side warp 1U and serving as the binding weft yarn is woven with the lower surface side wefts 2'L,7'L from below and is woven with the upper surface side weft 5'U from above. In addition, as shown in FIG. 6(*b*), the upper surface side warp 2U is woven with the upper surface side wefts 1'U,2'U,5'U,7'U from above. In addition, the lower surface side warp 2Lb located below the upper surface side warp 2U and serving as the binding weft yarn is woven with the upper surface side weft 2' U from above and is woven with the lower surface side wefts 5'L,7'L from below. Further, as shown in FIG. 6(*c*), the upper surface side warp 3U is woven with the upper surface side wefts 2'U,4'U, 6'U,7'U from above. The lower surface side warp 3Lb located below the upper surface side warp 3U and serving as the binding weft yarn is woven with the lower surface side wefts 1'L,4'L from below and is woven with the upper surface side weft 7'U from above. As shown in FIG. 6(*d*), the upper surface side warp 4U is woven with the upper surface side wefts 1'U,3'U,4'U,7'U from above. The lower surface side warp 4Lb located below the upper surface side warp 4U and serving as the binding weft yarn is woven with the lower surface side wefts 1'L,6'L from below and is woven with the upper surface side weft 4'U from above.

As shown in FIG. 6(*e*), the upper surface side warp 5U is woven with the upper surface side wefts 1'U,4'U,6'U,8'U from above. The lower surface side warp 5Lb located below the upper surface side warp 5U and serving as the binding weft yarn is woven with the lower surface side wefts 3'L,6'L from below and is woven with the upper surface side weft 1'L from above.

As shown in FIG. 6(*f*), the upper surface side warp 6U is woven with the upper surface side wefts 1'U,3'U,5'U,6'U from above. The lower surface side warp 6Lb located below the upper surface side warp 6U and serving as the binding weft yarn is woven with the lower surface side wefts 3'L,8'L from below and is woven with the upper surface side weft 6'U from above.

As shown in FIG. 6(*g*), the upper surface side warp 7U is woven with the upper surface side wefts 2'U,3'U,6'U,8'U from above. The lower surface side warp 7Lb located below the upper surface side warp 7U and serving as the binding weft yarn is woven with the lower surface side wefts 5'L,8'L from below and is woven with the upper surface side weft 3'L from above.

As shown in FIG. 6(*h*), the upper surface side warp 8U is woven with the upper surface side wefts 3'U,5'U,7'U,8'U from above. The lower surface side warp 8Lb located below the upper surface side warp 8U and serving as the binding weft yarn is woven with the lower surface side wefts 2'L,5'L from below and is woven with the upper surface side weft 8'U from above.

In such a situation, the upper surface side warps 4 U,5U,6U adjacent to each other pass over the one upper surface side weft 1'U to form a one knuckle. At this location, the lower surface side warp 5Lb serving as the binding weft yarn passes under the upper surface side warp 5U located to be the middle among the three upper surface side warps and passes over the upper surface side weft 1'U to form another knuckle.

In addition, at a location where the three upper surface side warps 1U,2U,3U pass over one upper surface side weft 2'U to form one knuckle, the lower surface side warp 2Lb serving as the binding weft yarn passes between the upper surface side warp 2U located to be the middle among the three upper surface side warps 1U,2U,3U and the upper surface side weft 2'U to form another knuckle.

In addition, at a location where the three upper surface side warps 1U,2U,3U pass over one upper surface side weft 2'U to form one knuckle, the lower surface side warp 2Lb serving as the binding weft yarn passes between the upper surface side warp 2U located to be the middle among the three upper surface side warps 1U,2U,3U and the upper surface side weft 2'U to form another knuckle.

In addition, at a location where the three upper surface side warps 6U,7U,8U pass over one upper surface side weft 3'U to form one knuckle, the lower surface side warp 7Lb serving as the binding weft yarn passes between the upper surface side warp 7U located to be the middle among the three upper surface side warps 6U,7U,8U and the upper surface side weft 3'U to form another knuckle.

In addition, at a location where the three upper surface side warps 3U,4U,5U pass over one upper surface side weft 4'U to form one knuckle, the lower surface side warp 4Lb serving as the binding weft yarn passes between the upper surface side warp 4U located to be the middle among the three upper surface side warps 3U,4U,5U and the upper surface side weft 4'U to form another knuckle.

In addition, at a location where the three upper surface side warps 8U,1U,2U pass over one upper surface side weft 5'U to form one knuckle, the lower surface side warp 1Lb serving as the binding weft yarn passes between the upper surface side warp 1U located to be the middle among the three upper surface side warps 8U,1U,2U and the upper surface side weft 5'U to form another knuckle.

In addition, at a location where the three upper surface side warps 5U,6U,7U pass over one upper surface side weft 6'U to form one knuckle, the lower surface side warp 6Lb serving as the binding weft yarn passes between the upper surface side warp 6U located to be the middle among the three upper surface side warps 5U,6U,7U and the upper surface side weft 6'U to form another knuckle.

In addition, at a location where the three upper surface side warps 2U,3U,4U pass over one upper surface side weft 7'U to form one knuckle, the lower surface side warp 3Lb serving as the binding weft yarn passes between the upper surface side warp 3U located to be the middle among the three upper surface side warps 2U,3U,4U and the upper surface side weft 7'U to form another knuckle.

In addition, at a location where the three upper surface side warps 7U,8U,1U pass over one upper surface side weft 8'U to form one knuckle, the lower surface side warp 8Lb serving as the binding weft yarn passes between the upper surface side warp 8U located to be the middle among the three upper surface side warps 7U,8U,1U and the upper surface side weft 8'U to form another knuckle.

In such a structure, the amount in which another knuckle formed by the lower surface side warp serving as the binding weft yarn protrudes toward the upper surface side is less than that of the one knuckle formed by the upper surface side warp.

By adopting such a structure, the industrial two-layer fabric with high rigidity, high air permeability, and good wear resistance can be provided, and a good hydration property can be obtained by decreasing the space density, while the number of the shooting counts of the wefts can be increased, and as a result, the industrial two-layer fabric with high rigidity can be provided.

What is claimed is:

1. The industrial two-layer fabric includes at least one upper surface side fabric constituted by upper surface side warps and upper surface side wefts, at least one lower surface side fabric constituted by lower surface side warps and lower surface side wefts, and the lower surface side warps serving as binding weft yarns, and includes three of the upper surface side warps arranged to be adjacent to each other in the at least one upper surface side fabric, whereby the upper surface side wefts pass over three consecutive upper surface side warps, and then, pass under one upper surface side warp to pass over another upper surface side warp, and then, passes under three consecutive upper surface side warps, and then each of the three upper surface side warps adjacent to each other passes over one or two upper surface side wefts to form one knuckle, and the lower surface side warp serving as the binding weft yarn passes between the upper surface side warp located to be middle among the three upper surface side warps and the upper surface side weft to form another knuckle, the another knuckle formed by the lower surface side warp serving as the binding weft yarn is configured such that an amount in which the another knuckle formed by the lower surface side warp serving as the binding weft yarn protrudes towards the upper surface side is less than that of the one knuckle formed by the upper surface side warp.

2. The industrial two-layer fabric according to claim 1, the adjacent upper surface side warps are divided into upper and lower sides to be woven with one upper surface side weft at an approach portion where the adjacent upper surface side warps among the three upper surface side warps are the most adjacent in a position other than the one knuckle.

* * * * *